US007337916B2

(12) United States Patent
Clougherty

(10) Patent No.: US 7,337,916 B2
(45) Date of Patent: Mar. 4, 2008

(54) PRESSURE/MOISTURE RELEASE COOKING CONTAINER

(75) Inventor: Kenan J. Clougherty, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 575 days.

(21) Appl. No.: 10/747,505

(22) Filed: Dec. 29, 2003

(65) Prior Publication Data

US 2005/0139090 A1 Jun. 30, 2005

(51) Int. Cl.
*B65D 51/16* (2006.01)

(52) U.S. Cl. ..... 220/785; 220/366.1; 220/DIG. 19; 220/780; 229/125.17

(58) Field of Classification Search ..... 220/366.1, 220/912, 785, 787, 789, DIG. 19, 780; 215/307; D9/439; 229/125.17
See application file for complete search history.

(56) References Cited

U.S. PATENT DOCUMENTS

| | | | | | |
|---|---|---|---|---|---|
| 2,769,457 | A | * | 11/1956 | Wittenberg | 137/512 |
| 3,133,666 | A | * | 5/1964 | Henchert | 220/782 |
| 3,173,571 | A | | 3/1965 | Cserny et al. | |
| 3,362,565 | A | | 1/1968 | McCormick | |
| 3,381,872 | A | | 5/1968 | Holder et al. | |
| 3,508,678 | A | * | 4/1970 | Noren et al. | 220/785 |
| 3,522,900 | A | * | 8/1970 | Nicholson | 220/203.01 |
| 3,613,938 | A | | 10/1971 | Westcott | |
| 3,672,536 | A | | 6/1972 | Kinney et al. | |
| 3,880,187 | A | * | 4/1975 | Kneusel | 137/843 |
| 4,143,787 | A | * | 3/1979 | Walker | 220/203.13 |
| 4,193,402 | A | * | 3/1980 | Rumpler | 604/415 |
| 4,266,689 | A | | 5/1981 | Asher | |
| 4,583,654 | A | * | 4/1986 | Pufpaff et al. | 220/789 |
| 4,708,259 | A | | 11/1987 | Olimpio | |
| 4,760,936 | A | | 8/1988 | Mueller | |
| 4,843,641 | A | * | 7/1989 | Cusick et al. | 2/457 |
| 5,121,858 | A | * | 6/1992 | Chong | 222/397 |
| 5,147,059 | A | * | 9/1992 | Olsen et al. | 220/281 |
| 6,082,576 | A | * | 7/2000 | Counts-Bradley et al. | 220/787 |
| 2005/0167430 | A1 | * | 8/2005 | Varadarajan | 220/258.1 |

* cited by examiner

*Primary Examiner*—Anthony D. Stashick
*Assistant Examiner*—James Smalley
(74) *Attorney, Agent, or Firm*—Alston & Bird LLP

(57) ABSTRACT

The present invention includes an improved food enclosure designed to harness the steam produced during cooking so as to rapidly thaw and cook the food; however, the enclosure also advantageously vents the steam in order to provide a crispier, more desirable food product. A "venting" container according to one embodiment of the present invention, includes a tubular body having at least one open end and a cap for engaging the open end. The cap comprises upper and lower ends, which define an intermediate region therebetween. The tubular body and cap are at least partially sealed together by frictional forces resulting from the interference between opposing radially extending protrusions disposed on both the tubular body and the cap. These frictional forces are opposed and eventually overcome by a steam pressure generated from within the container, whereby the cap is driven from a closed to a vented position.

18 Claims, 2 Drawing Sheets

PRESSURE/MOISTURE RELEASE COOKING CONTAINER

FIELD OF THE INVENTION

The present invention relates to sealable containers and, more particularly to an apparatus for venting a sealed container, such as a container for heated food products that require venting during cooking or warming.

BACKGROUND OF THE INVENTION

Many products, especially food products in particular, are provided in sealed containers to prevent spoilage or contamination. In addition, it is common for manufacturers to sell food products frozen or refrigerated within microwavable or oven-safe containers, such that the food may be heated in the container just prior to being eaten. These refrigerated or frozen food products are especially desirable to consumers because they have a reduced potential for spoilage and may be quickly prepared.

Such heatable containers for frozen or refrigerated food products are sealed after filling in order to prevent contamination during shipping and handling. When food is heated, water is generally emitted in the form of steam. This steam builds within food containers and can help to rapidly thaw and cook the packaged food. If the package does not allow for at least some escape of steam during cooking, a high steam pressure can build up within the container. Such pressures can explode the container. As a result, partial venting of heated food product containers is often recommended.

One example of a partially vented food product container is provided by conventional frozen dinners. These dinners are produced and sold within containers comprised of a thin polymer film sealed over a microwavable or oven-safe bowl or tray. Prior to heating, consumers are instructed to place small cuts in the polymer film or to peel back a corner of the film, to moderately vent the steam and prevent potentially dangerous high steam pressures. Although vented by the small cuts or peeled-back portion, the polymer film retains some steam within the container to more rapidly cook the dinner.

As conventional "frozen dinner" type designs are used more frequently, it has become evident such designs inherently include a number of drawbacks. For example, they are costly to produce and fail to adequately harness steam during the initial cooking cycles, thereby requiring an extended cooking time and potentially resulting in a partially cooked food product. Further, should a consumer provide less than adequately sized cuts in the polymer film prior to cooking, steam may not be properly vented. As a result, steam remaining in the container may overcook the food product and/or cause the food product to become soggy, which in many cases is undesirable. To alleviate the above problems and produce crisp food products, it is desirable to release the steam once its initial thawing and cooking effects have been realized.

It is further desirable to package foods within tubular paperboard containers that may optionally include laminates such as kraft or recycled paper, foil and/or polymer plys, and exterior label layers. Such tubular containers provide a cost effective, re-closable, and easily storable alternative to the relatively expensive, polymer based, frozen-dinner type bowls discussed above.

Accordingly, it is desirable to produce an improved tubular food product container that is readily closable so as to preserve the food from spoilage and encourage accelerated cooking. It is further desirable, however, for the container to readily vent steam following initial cooking cycles, thereby providing a crispier, more desirable food product.

BRIEF SUMMARY OF THE INVENTION

The above needs are addressed and other advantages are achieved by the present invention, which provides a food container that can allow some steam produced during initial heating or cooking to accumulate within the container so as to rapidly thaw and heat or cook the food; however, the container also advantageously vents the steam in order to provide a crispier, more desirable food product. A "venting" container according to one embodiment of the present invention includes a tubular body having an open end and a cap engaging the open end. The cap comprises upper and lower ends, which define an intermediate region therebetween. The tubular body and cap are at least partially sealed together by interference between opposing radially extending protrusions disposed on both the tubular body and the cap. Frictional forces between the body and cap protrusions are opposed and eventually overcome when sufficient steam pressure builds up within the container, whereby the cap is driven from a closed to a vented position.

According to one embodiment of the present invention, the venting container includes a tubular body having a radially projecting bead circumscribing the open end of the tubular body. Further, the cap includes an outwardly extending lip disposed around at least a portion of the upper end of the cap, an upper protrusion disposed around at least a portion of the intermediate region of the cap, and a retaining protrusion disposed around at least a portion of the lower end of the cap. According to this embodiment, the cap is "press fit" into the open end of the tubular body until the cap reaches a closed position, wherein the outwardly extending lip seats against the open end of the tubular body, the upper protrusion of the cap contacts the lower surface of the radially projecting bead, and the retaining protrusion of the cap is positioned below the radially projecting bead.

During heating, steam pressure is generated within the venting container. Upon reaching a certain pressure, the steam drives the cap from the closed position to a vented position wherein the upper protrusion is driven over the radially projecting bead of the tubular body, thereby creating a passage therebetween and venting the container. As the cap translates upwardly to the vented position the retaining protrusions contact the radially projecting bead of the tubular body and thereby prevent full cap removal.

According to another embodiment, the cap includes a plurality of vent channels positioned generally between the upper protrusion and the retaining protrusion and which may extend partially into one or both protrusions so as to facilitate proper venting when the container is in the vented position. Alternatively, in another embodiment, a plurality of ribs may be provided to ensure proper venting. Steam may thus escape, in the vented position, via passages formed between the plurality of ribs.

In another embodiment of the present invention, the cap may form a receptacle that is "press fit" over the open end of the tubular body. In this embodiment, the upper and retaining protrusions are formed at a radially inwardly facing surface of the cap and the tubular container body is circumscribed by a radially projecting bead that is outwardly directed so as to seat against the upper protrusion and retaining protrusion of the cap, when in the closed and vented positions respectively. In this embodiment, as with those described above, a plurality of vent channels or ribs may be provided on the cap for venting the container in the vented position.

According to other embodiments, the tubular body and/or cap may be comprised of paperboard for cost effective and environmental friendly consumer use. Alternatively, the tubular body and/or cap may be comprised of plastic to provide a relatively durable and reusable venting container. Regardless of material, the venting container may have various cross section shapes, including circular, cylindrical, oval, square, rectangular and the like.

In yet another embodiment, the upper protrusion of the cap may be radially deformable to facilitate longitudinal translation of the cap from closed to vented positions. According to another embodiment, the radially projecting bead of the tubular body may be radially deformable to facilitate longitudinal translation, or a pop over motion of the upper protrusion of the cap, as it is driven from closed to vented positions.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
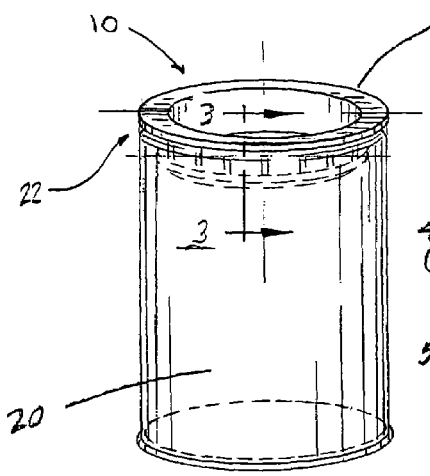
FIG. 1 is a perspective view of a venting container in accordance with one embodiment of the present invention.

Referring to FIG. 1, a venting container 10 in accordance with one embodiment of the present invention has been illustrated. According to this embodiment, the venting container 10 includes a tubular body 20 having an open end 22. As further illustrated in FIG. 3, the tubular body 20 includes a radially projecting bead 25 circumscribing the open end 22. A cap 40 is disposed within the open end 22 so as to substantially seal the venting container 10 when placed in a "closed" position as described in further detail below.

Figure 2:
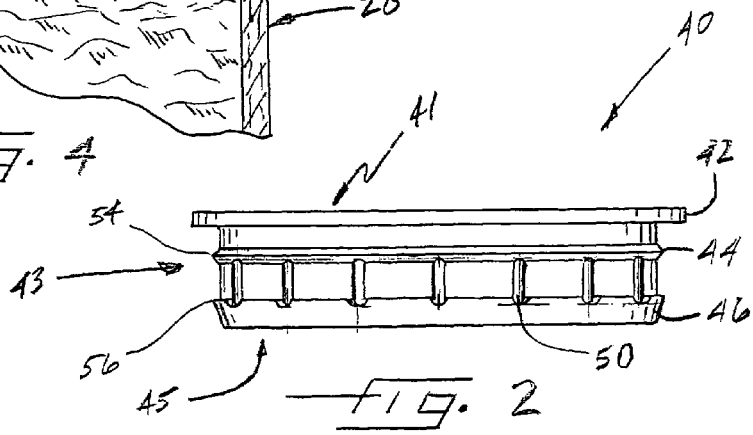
FIG. 2 is a detail view of a cap in accordance with one embodiment of the present invention.

FIG. 2 provides a detail illustration of a cap 40 in accordance with one embodiment of the present invention. Preferably, the cap 40 includes upper and lower ends 41, 45 that define an intermediate region 43 therebetween. Further, an outwardly extending lip 42 may be provided around at least a portion of the upper end 41 of the cap 40. In the illustrated embodiment, an upper protrusion 44 is disposed around at least a portion of the intermediate region 43 of the cap 40, and a retaining protrusion 46 is disposed around at least a portion of the lower end 45 of the cap 40. The protrusions 44 and 46 respectively function in "closed" and "vented" positions of the cap, as described below.

Figure 3:
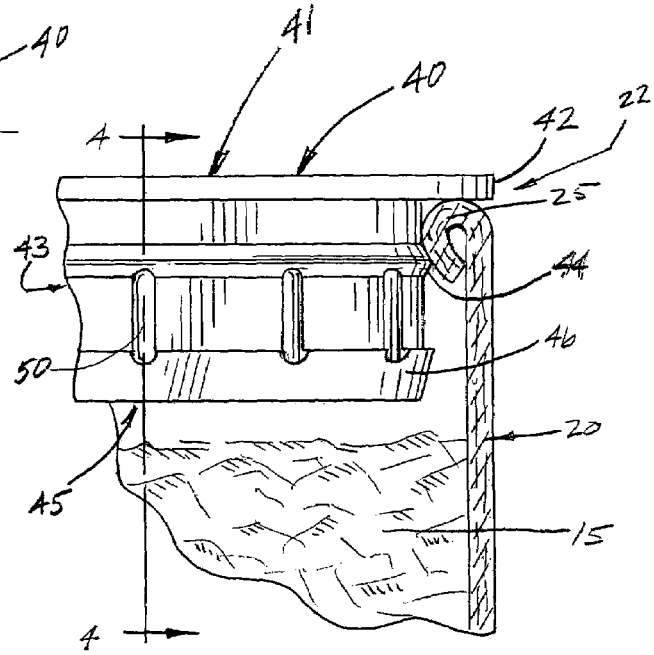
FIG. 3 is a section view of the venting container of FIG. 1, taken along section line 3-3 in FIG. 1, with the cap in a closed position.

The venting container 10 according to the present invention is preferably designed to provide a substantially sealed enclosure when products are initially packaged therein. Accordingly, the open end 22 of the tubular body 20 is adapted to provide a receptacle for receiving the cap 40 in a friction-fit manner so that the cap substantially seals the container, as shown in FIG. 3. Additional sealing materials such as wax, polymers, hot melts, and the like, may be used in the interface between the outwardly extending lip 42 and the radially projecting bead 25. Various heatable products may be housed within this enclosure, including food products such as biscuits, rolls, fried foods, cookies, frozen foods and the like. Essentially, any product requiring sealing from an ambient environment during transport or sale and producing an accumulated steam pressure that is preferably vented during heating is suitable for packaging within the enclosure.

Figure 4:
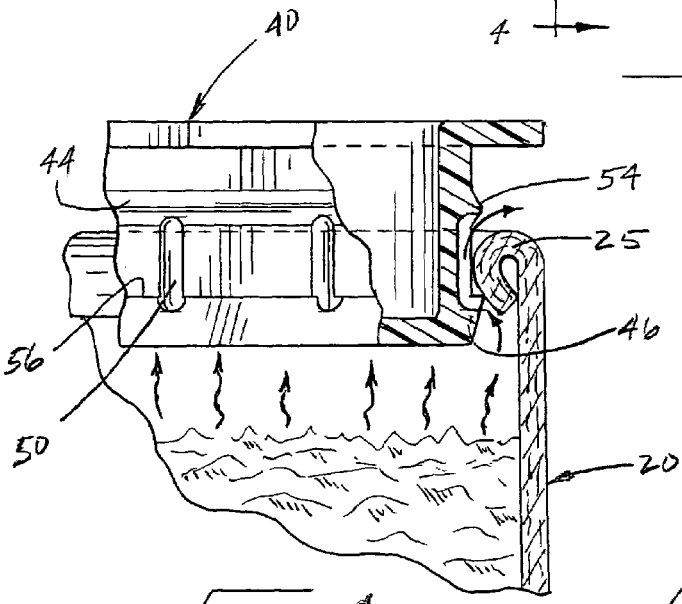
FIG. 4 is a partially sectioned perspective view of the venting container, taken along line 4-4 in FIG. 3, with the cap in a vented position.

As noted, the venting container 10 according to the present invention is configured to have both "closed" and "vented" positions. A "closed" position according to one embodiment is depicted in FIG. 3, while FIG. 4 illustrates a "vented" position. In the closed position, as illustrated in FIG. 3, the cap 40 is inserted into the open end 22 of the tubular body 10 such that the outwardly extending lip 42 of the cap 40 abuts the upper surface of the radially projecting bead 25. In one embodiment of the present invention, the outwardly extending lip 42 may be adapted to contact the radially projecting bead 25, and thereby substantially prevent substances from entering the venting container 10. Alternatively or additionally, the upper protrusion 44 of the cap can contact a lower surface of the radially projecting bead 25 to substantially prevent gas, vapor or other substances from escaping the venting container 10 at normal pressures.

Depending upon the application, the structural composition of the tubular body 20 and the cap 40 may vary. For example, a tubular body 20 in accordance with the present invention may be comprised of paperboard, plastic, metals, or any combination of these and other similar materials. Additionally, the cap 40 may be similarly comprised. The shape of the venting container 10 may also vary. Although depicted as cylindrical, a venting container 10 according to the present invention may have any cross-section commonly known to one of ordinary skill in the art. For example, venting containers 10 having square, triangular, circle, rectangular, or other similar cross-sections may readily be produced.

As the pressure within the venting container 10 is increased, for example, when heating a steam-producing food product such as biscuits, an upwardly directed steam force is exerted on the lower surface of the cap 40. Eventually, the steam pressure builds to a level at which the cap 40 is driven upwardly by the applied steam force. According to one embodiment, the radially projecting bead 25 is deformable such that as the cap 40 is driven upwardly, the upper protrusion 44 deforms the radially projecting bead 25 outwardly and the upper protrusion 44 thus can clear the bead and allow the cap to move to the "vented" position illustrated in FIG. 4. Alternatively, in another embodiment, the upper protrusion 44 is deformable and deflected radially by a relatively rigid inwardly projecting bead 25 as the cap 40 is driven upwardly. Finally, in another embodiment, both the upper protrusion 44 and the inwardly projecting bead 25 may be radially deformable to accommodate upward movement of the cap 40. As the cap 40 translates upwardly, it is prevented from complete removal by the retaining protrusion 46 which is disposed at least partially around the lower end 45 of the cap 40. The retaining protrusion 46 contacts the radially projecting bead 25, thereby stopping the upward movement of the cap 40.

Figure 6:
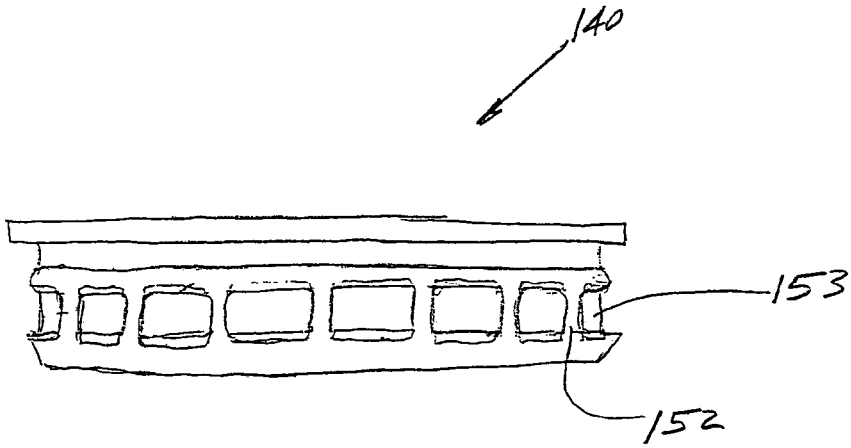
FIG. 6 is a detail view of a cap in accordance with one embodiment of the present invention, wherein the cap includes a plurality of ribs for venting the container.

Upon reaching the vented position, the steam or other vapor produced during heating of the enclosed product is allowed to escape the container. Advantageously, by venting the container in this manner, food products may be rapidly prepared having a crispier crust or other similar characteristics that are desirable to consumers. As illustrated in FIG. 4, steam may escape through a plurality of channels 50 which are formed on the cap 40 at least partially between the upper protrusion 44 and the retaining protrusion 46. In one embodiment, the plurality of channels 50 extend into the upper protrusion 44 and the retaining protrusion 46, stopping just below the apex of each protrusion 54, 56. Alternatively, in the embodiment illustrated in FIG. 6, a plurality of ribs 152 may be provided in the region between the protrusions so that steam may escape, in the vented position, via passages 153 formed between the plurality of ribs 152.

Figure 5:
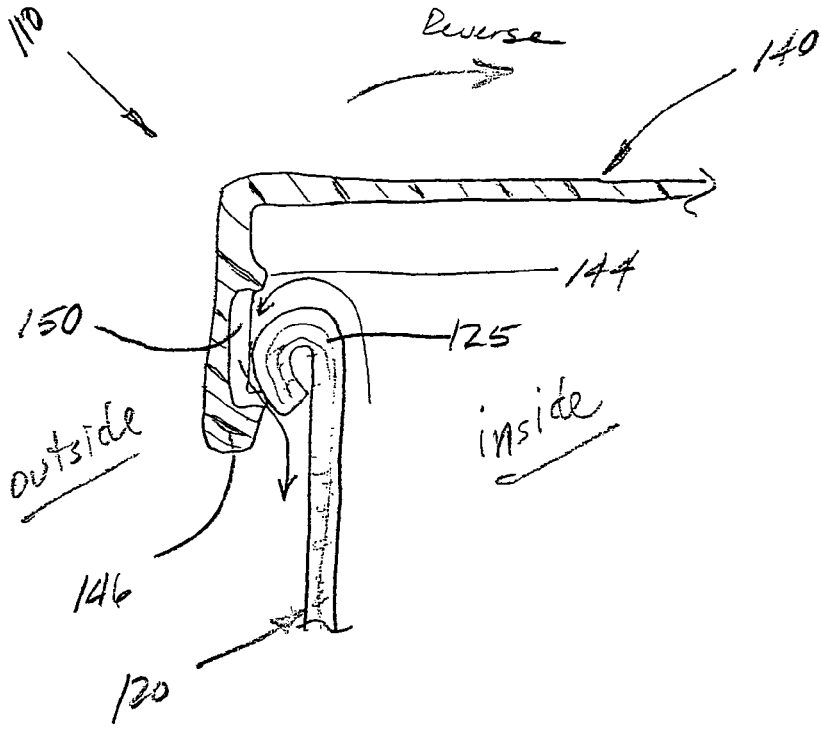
FIG. 5 is a section view of yet another embodiment of the present invention, taken along line 4-4 in FIG. 3, wherein the cap receives a tubular body having an outwardly directed radially projecting bead.

In yet another embodiment of the present invention, as illustrated by FIG. 5, the cap 140 is adapted to provide a receptacle for receiving the tubular body 120 so the cap fits around the outside of the upper end of the body. An inner surface of the cap includes an upper protrusion 144 and a retaining protrusion 146. In this embodiment, the tubular body 120 is circumscribed by a radially projecting bead 125 that is outwardly directed so as to seat against the upper protrusion 144 and the retaining protrusion 146 in a friction-fit manner, when in the closed and vented positions respectively. In this embodiment, as with those described above, a plurality of channels 150 are provided for venting the container 110 in the vented position.

Other embodiments of the present invention may be provided without altering the inventive concepts disclosed herein. For example, in one embodiment, the retaining protrusion 46 of the cap 40 may be structured as a barb. Further, in another embodiment, the radially projecting bead 25 of the tubular body 20 may be simply formed by inwardly rolling an upper edge surface (not shown) of the open end 22 of the tube body 20. Finally, although the cap 40 is shown in FIGS. 1 and 4 as having a closed lower end 45 and a substantially hollow upper end 41, other embodiments of the present invention may include a cap 40 having a substantial planar upper end and a substantially hollow lower end as shown in FIG. 5.

Many modifications and other embodiments in the invention set forth herein will come to mind to one of ordinary skill in the art to which these inventions pertain having the benefit of the teachings presented in the foregoing descriptions and the associated drawings. Therefore, it is to be understood that the inventions are not to be limited by the specific embodiments disclosed and that modifications and other embodiments are intended to be included within the scope of the appended claims. Although specific terms are employed herein, they are used in a generic and descriptive sense only and not for purposes of limitation.

That which is claimed:

1. A venting container, comprising:

a tubular body for enclosing a heatable product, said tubular body having an open end and a radially projecting bead circumscribing said open end, wherein said tubular body is comprised of paperboard; and a cap engaging said open end of said tubular body for at least partially sealing said heated product during initial cooking, and wherein said cap is longitudinally moveable between closed and vented positions by steam pressure generated within the container by heating said heatable product; said cap comprising, upper and lower ends defining an intermediate region therebetween, an upper protrusion disposed around at least a portion of said intermediate region for contacting a lower surface of said radially projecting bead of said tubular body in said closed position, wherein said upper protrusion is moved over said radially projecting bead when said cap is moved into said vented position, a retaining protrusion disposed around at least a portion of said lower end, wherein said retaining protrusion is structured to contact said radially projecting bead in said vented position, thereby preventing said cap from separating from said tubular body, and a plurality of vent channels disposed substantially between said upper protrusion and said retaining protrusion for venting said steam pressure in said vented position.

2. A venting container in accordance with claim 1, further comprising an outwardly extending lip disposed around at least a portion of said upper end of said cap, wherein said outwardly extending lip of said cap is adapted to contact said open end of said tubular body in said closed position, thereby properly seating said cap within said tubular body.

3. A venting container in accordance with claim 1, wherein said plurality of vent channels extend at least partially through said upper protrusion for venting said steam pressure in said vented position.

4. A venting container in accordance with claim 1, wherein said plurality of vent channels extend at least partially through said retaining protrusion of said cap for venting said steam pressure in said vented position.

5. A venting container in accordance with claim 1, wherein said tubular body is comprised of plastic.

6. A venting container in accordance with claim 1, wherein said cap is comprised of paperboard.

7. A venting container in accordance with claim 1, wherein said cap is comprised of plastic.

8. A venting container in accordance with claim 1, wherein said upper protrusion is deformable so as to deform radially to facilitate the longitudinal movement of said cap from said closed position to said vented position.

9. A venting container in accordance with claim 1, wherein said radially projecting bead is deformable such that the bead deforms radially to facilitate the longitudinal movement of said cap from said closed position to said vented position.

10. A venting container, comprising:

a tubular body for enclosing a heatable product, said tubular body having an open end and a radially projecting bead circumscribing said open end, wherein said tubular body is comprised of paperboard; and a cap disposed within said open end of said tubular body for at least partially sealing said heated product during initial cooking, and wherein said cap is moveable between closed and vented positions by steam pressure generated by heating said heatable product; said cap comprising, upper and lower ends defining an intermediate region therebetween, an upper protrusion disposed around at least a portion of said intermediate region for at least partially sealing against said radially projecting bead of said tubular body in said closed position, wherein said upper protrusion is moved over said radially projecting bead into said vented position, a retaining protrusion disposed around at least a portion of said lower end, wherein said retaining protrusion is structured to contact said radially projecting bead in said vented position, thereby preventing said cap from separating from said tubular body, and a plurality of vent ribs disposed between said upper protrusion and said retraining protrusion, said plurality of vent ribs defining a plurality of detents therebetween for venting said steam pressure in said vented position.

11. A venting container in accordance with claim 10, further comprising an outwardly extending lip disposed around at least a portion of said upper end of said cap, wherein said outwardly extending lip of said cap is adapted to contact said open end of said tubular body in said closed position, thereby properly seating said cap within said tubular body.

12. A venting container in accordance with claim 10, wherein said plurality of detents extend at least partially through said upper protrusion for venting said steam pressure in said vented position.

13. A venting container in accordance with claim 10, wherein said plurality of detents extend at least partially through said retaining protrusion for venting said steam pressure in said vented position.

14. A venting container in accordance with claim 10, wherein said tubular body is comprised of plastic.

15. A venting container in accordance with claim 10, wherein said cap is comprised of paperboard.

16. A venting container in accordance with claim 10, wherein said cap is comprised of plastic.

17. A venting container in accordance with claim 10, wherein said upper protrusion is deformable so as to deform radially to facilitate the movement of said cap from said closed position to said vented position.

18. A venting container in accordance with claim 10, wherein said radially projecting bead is deformable so as to deform radially to facilitate the movement of said cap from said closed position to said vented position.

* * * * *